US005906011A

United States Patent [19]

Fleming

[11] Patent Number: 5,906,011

[45] Date of Patent: May 25, 1999

[54] DUAL FOOT PEDAL-OPERATED FLUSH TOILET

[75] Inventor: David Charles Robert Fleming, Grimsby, Canada

[73] Assignee: Sanitation Equipment Limited, Concord, Canada

[21] Appl. No.: 09/163,549

[22] Filed: Sep. 30, 1998

[51] Int. Cl.[6] ..... E03D 1/18

[52] U.S. Cl. ..... 4/329; 4/435; 4/434

[58] Field of Search ..... 4/329, 308, 300, 4/434, 435, 471, 460, 466

[56] References Cited

U.S. PATENT DOCUMENTS 3,932,901 1/1976 Inui et al. ..... 4/435

4,710,988 12/1987 Stewart ..... 4/434

5,548,850 8/1996 Geeham ..... 4/434

*Primary Examiner*—David J. Walczak

*Attorney, Agent, or Firm*—Bereskin & Parr

[57] ABSTRACT

A flush toilet for a recreational vehicle has a flush mechanism including a pair of foot pedals, one for opening the bowl outlet closure of the toilet, and the other for opening the flush water valve. Depression of the first foot pedal also depresses the water valve foot pedal, though that pedal can also be operated separately. An actuating cable for the water valve extends through the arm of the bowl closure foot pedal so that, if the water valve foot pedal breaks or is damaged, the water valve can still be opened for rinsing the bowl.

6 Claims, 10 Drawing Sheets

DUAL FOOT PEDAL-OPERATED FLUSH TOILET

FIELD OF THE INVENTION

This invention relates generally to flush toilets of the type typically used in recreational vehicles and other "occasional use" environments. It is to be understood, however, that the invention is not limited in this respect.

BACKGROUND OF THE INVENTION

A toilet for a recreational vehicle typically is assembled from a number of plastic mouldings, including an upper moulding which defines the toilet bowl, and a lower moulding or "shell" on which the bowl is supported. The bowl has a waste outlet that discharges into the shell and the shell in turn has an outlet at its lower end which is the main waste outlet from the toilet. In a recreational vehicle, the toilet is installed so that this main outlet communicates with a waste disposal conduit from the vehicle. The waste outlet from the toilet bowl is normally closed by a bowl seal which can be opened for flushing the toilet. Provision is made to deliver water into the bowl for flushing out waste, and for rinsing the surface of the bowl.

U.S. Pat. No. 4,710,988 (Stewart—assigned to Sanitation Equipment Limited) discloses a toilet of the general type discussed above. The toilet has a foot pedal operated flush mechanism. When the pedal is depressed, flush water is delivered into the bowl and the bowl seal is opened for discharge of waste. Other examples of recreational vehicle toilets with a foot pedal operated flush mechanism are disclosed in U.S. Pat. Nos. 3,601,820 and 5,060,320 (both to Sargent, et al.).

The toilet disclosed in the '320 patent has separate pedals for dispensing flush water and opening of the bowl seal, but the pedals are designed to co-act so that flush water is always discharged into the bowl when the bowl seal is opened. A possible disadvantage of this design is that failure of the foot pedals to properly co-act, or failure of or damage to the flush water foot pedal could result in the inability to add water to the bowl, and possible consequent unsanitary conditions. Particularly since recreational vehicle toilets may be used only infrequently, it is desirable for the user to be able to leave the toilet in a condition in which the bowl has been rinsed, even if there has been some failure or malfunction.

An object of the present invention is to provide a toilet which addresses the shortcomings of the prior art.

SUMMARY OF THE INVENTION

The toilet provided by the invention has a housing which includes a bowl for receiving waste. Closure means is provided for normally closing the bowl outlet and is operable to open the outlet for discharge of waste from the bowl. The toilet also includes water supply means operable to deliver water into the bowl and a foot pedal assembly comprising first and second foot pedals for actuating respectively the bowl closure means and the water supply means. Each foot pedal includes an arm having an outer end portion accessible to a user of the toilet, externally of the housing, and an inner end portion coupled to the housing about a pivot axis oriented so that up or down movement of the outer end portion of the arm causes the arm to move about the pivot axis. The arms of the respective foot pedals are disposed side-by-side and the arm of the second foot pedal includes a lateral extension below the arm of the first foot pedal so the depression of the first foot pedal also causes depression of the second foot pedal. First and second actuating elements extend between the foot pedals and the bowl closure means and the water supply means respectively. The bowl closure means is opened by tensioning of the first actuating element and the water supply means is operated by tensioning of the second actuating element. The first actuating element is coupled to the arm of the first foot pedal at a location between the end portions of the pedal so that depression of the pedal tensions the element. The second actuating element extends through an opening in the arm of the first foot pedal and is coupled to the lateral extension of the arm of the second foot pedal. The second actuating element includes, below the arm of the first foot pedal, an end fitment larger than the opening in the first foot pedal so that the second actuating element can be tensioned by depression of the foot pedal arm in the event of failure of the second foot pedal arm or its extension.

In summary, the foot pedal assembly of the toilet provided by the invention is designed so that depression of the first foot pedal for opening the bowl closure means will automatically also deliver flush water into the bowl for rinsing the bowl. Further, since the actuating element (e.g. a cable) for operating the water supply means passes through the foot pedal for operating the bowl closure means, the user of the toilet is assured of always being able to add water to the bowl even if the pedal for the water supply means (the second pedal) should fail or if there should be some failure of the lateral extension of the second foot pedal arm. The user is then at least able to rinse the bowl and leave the toilet in a sanitary condition while awaiting service.

Preferably, opposing faces of the arms of the respective foot pedals are flat, and the arm of the second (flush water) foot pedal comprises a member which is planar in a direction normal to said pivot axis, for up and down movement closely adjacent the arm of said first foot pedal. The second foot pedal arm can then be a sheet metal fabrication in which the lateral extension below the arm of the first foot pedal is formed by a tab that is folded out of the general plane of the arm.

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENTS

The drawings show a toilet that is generally similar to the toilet showed in the '988 (Stewart) patent referred to previously. Reference may be had to the Stewart patent for specific details of the toilet and its components. The disclosure of the Stewart patent is incorporated herein by reference.

Figure 1:
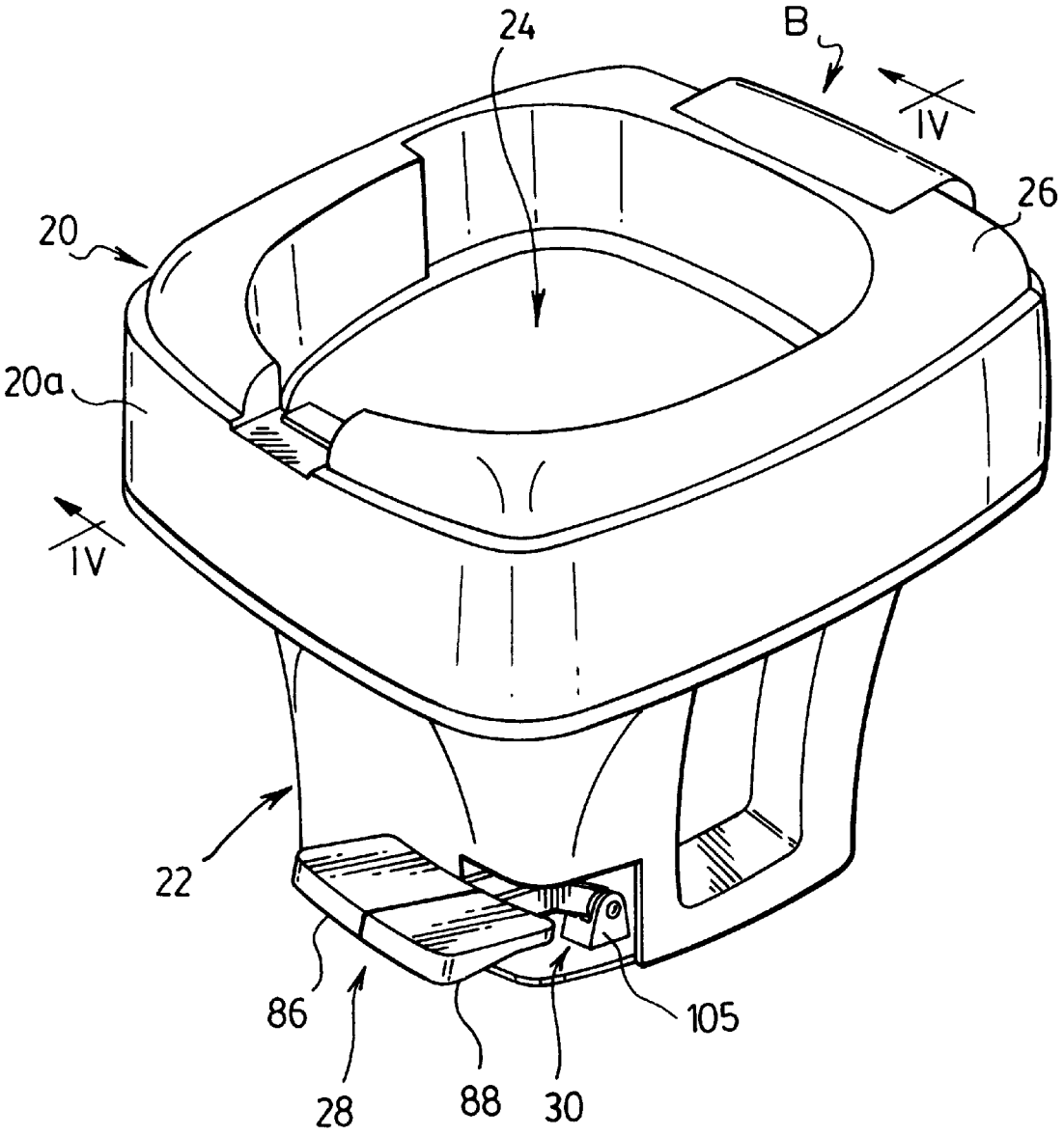
FIG. 1 is a perspective view from above and to the front and one side of a recreational vehicle toilet in accordance with this embodiment of the invention.
Figure 2:
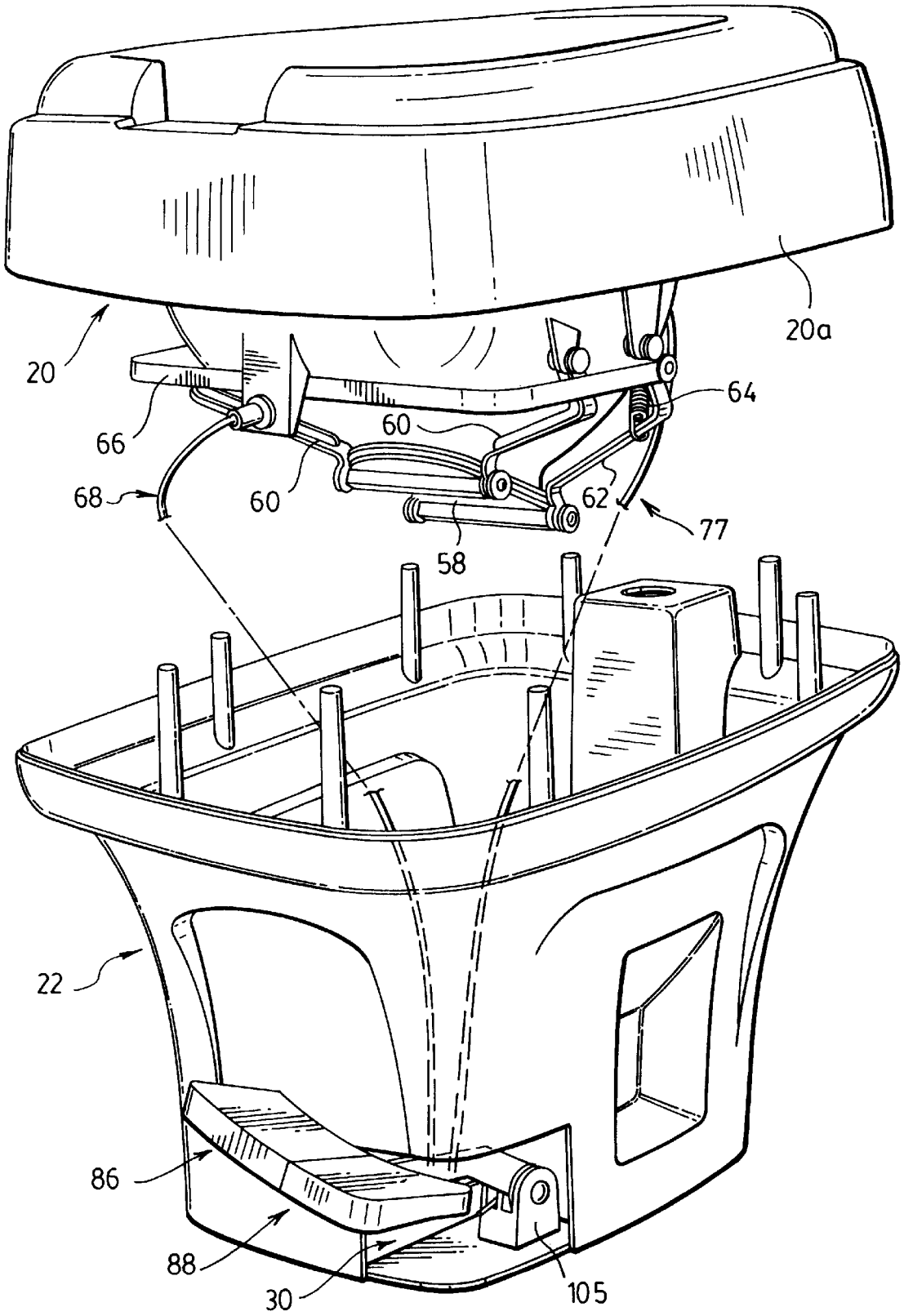
FIG. 2 is a partially exploded perspective view of the toilet of FIG. 1.

As seen in FIGS. 1 and 2 of the drawings of the present application, the toilet comprises upper and lower main plastic mouldings 20 and 22 respectively. The upper moulding 20 includes a toilet bowl 24 which is surrounded at the top by a seat-like formation 26. In the finished toilet, an additional plastic moulding defining an actual seat overlies formation 26 and a lid is provided above the seat; however, the lid and seat have not been shown.

Outwardly of formation 26, moulding 20 includes a skirt 20*a* that in effect "sits" on the lower moulding (or shell) 22. The two mouldings provide a housing for the toilet that includes bowl 24.

A foot pedal assembly 28 is mounted in a recess 30 at the bottom of moulding 22, in a position to be conveniently accessible to a person standing in front of the toilet. Assembly 28 will be described in detail later.

Figure 3:
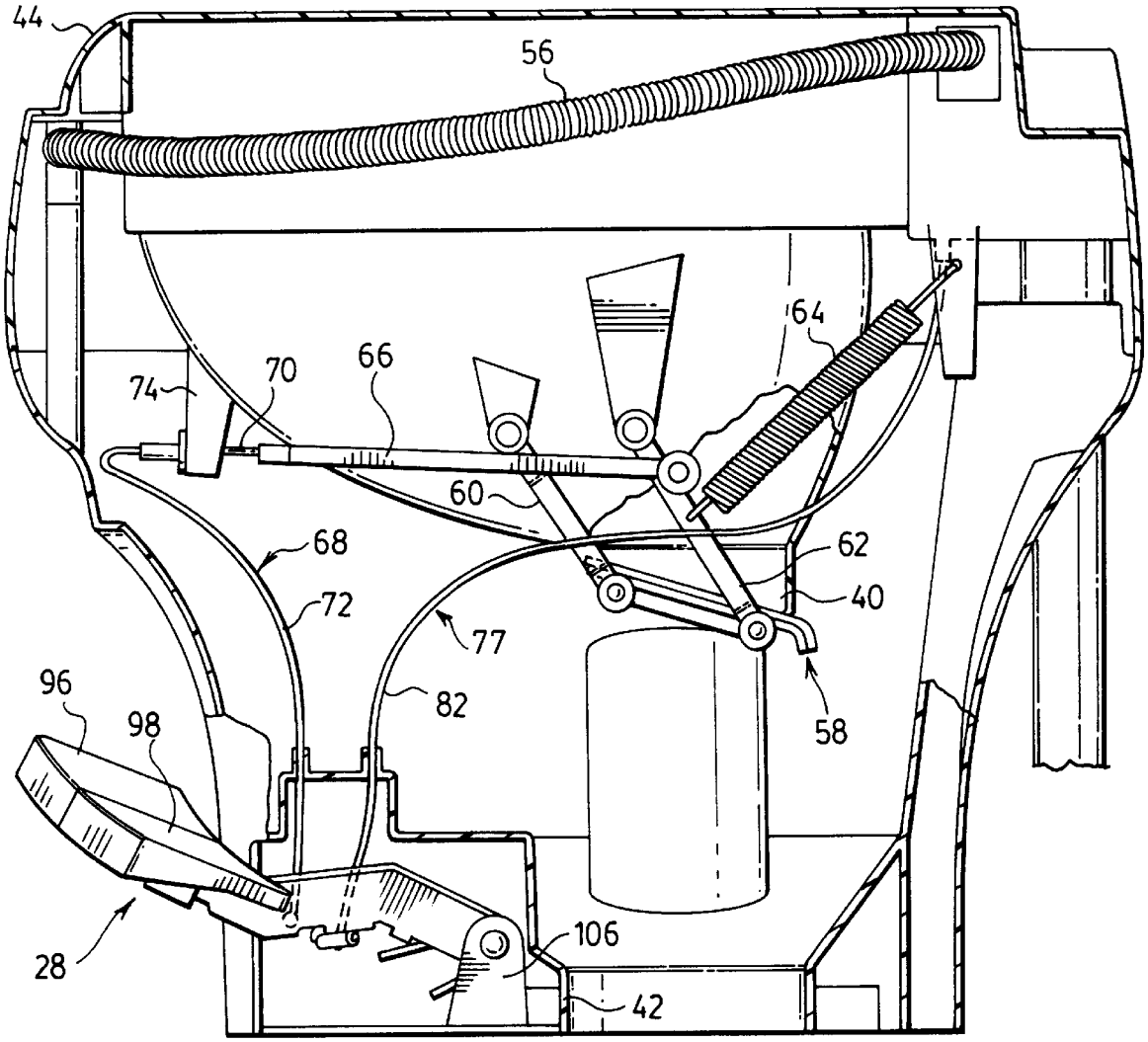
FIG. 3 is a side elevational view from the right in FIG. 1 with the housing of the toilet largely broken away to show internal structure.

Referring now to FIGS. 2 and 3, it will be seen that the toilet bowl 24 has an outlet 40 through which waste can pass from the bowl 24 into the interior of the shell defined by moulding 22. An outlet 42 in shell 22 provides the main outlet from the toilet and normally is coupled to a waste disposal conduit in a recreational vehicle.

Bowl 24 has a rim 44 that is partly encircled by a water pipe 46 (FIG. 4) having openings through which water can be dispensed onto the interior surface of the bowl as indicated at 48. A main water supply pipe to the toilet is indicated at 50 and leads to a water control valve 52 having an outlet that communicates with pipe 46 via a hose 56 (FIG. 3).

Figure 4:
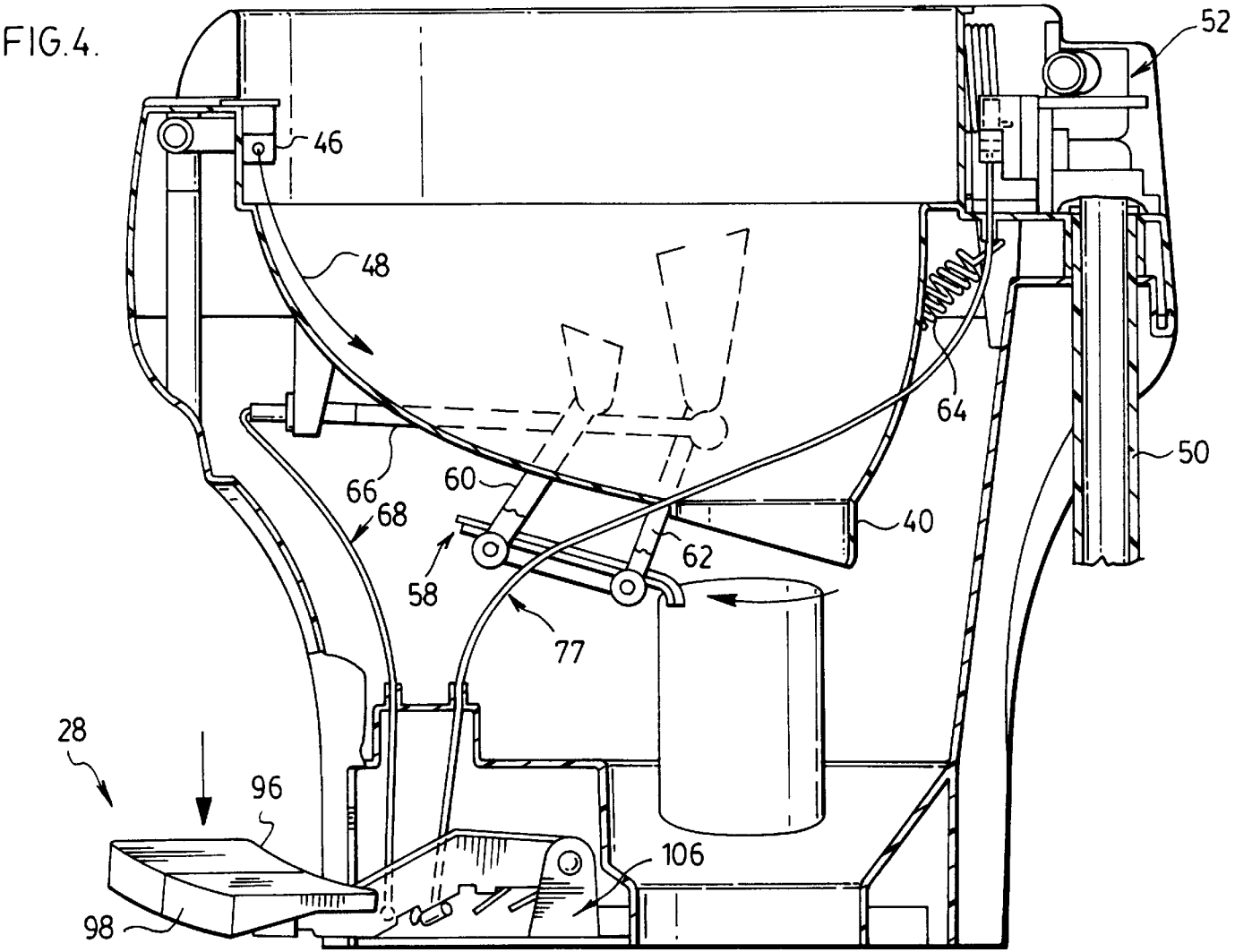
FIG. 4 is a vertical sectional view on line IV—IV in FIG. 1.

In FIG. 4, a bowl seal for the bowl outlet 40 is shown at 58 in a position spaced laterally from bowl outlet 40. Bowl seal 58 normally lies across and closes outlet 40 as shown in FIGS. 2 and 3 but can be moved to the position in which it is shown in FIG. 4 to open the outlet and allow discharge of waste from the toilet bowl.

Figure 5:
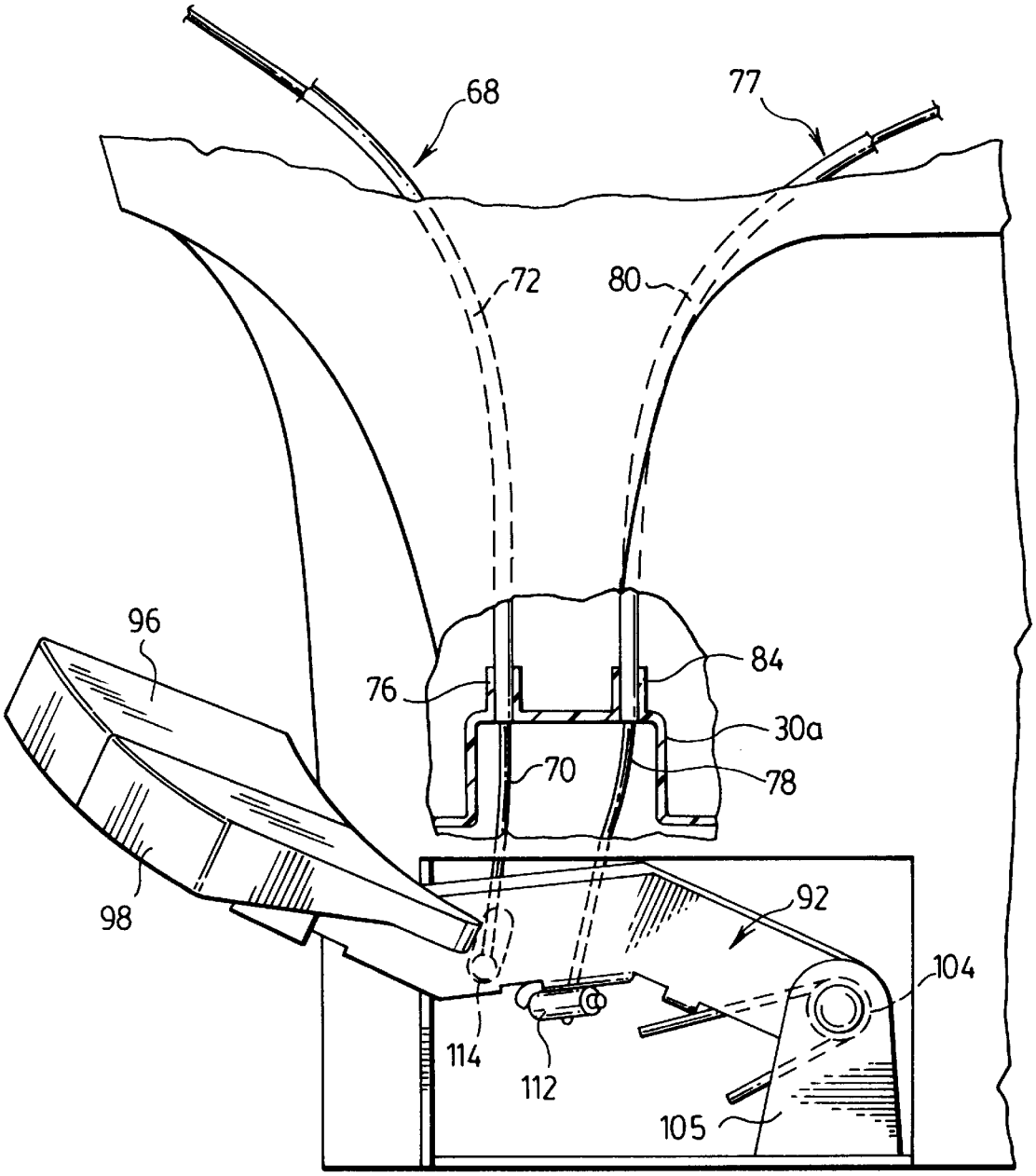
FIG. 5 is a perspective view of part of the toilet that includes the foot pedal assembly, in which part of the toilet housing is shown broken away to reveal internal structure.

Bowl seal 58 is carried by two pairs of links 60, 62 that extend between the seal and the bowl 24. The other link in each pair is at the opposite side of the bowl as compared with the side that visible in FIGS. 3 and 4; the "second" link 60 is partially visible in FIG. 2. A tension spring 64 (FIG. 2) extends between a fixed point inside the toilet housing and one of the links 62 for normally maintaining the bowl seal in its closed position. A yoke 66 embraces the bowl and extends between the two links 60 for moving the bowl seal from the closed position to the open position. Yoke 66 is actuated by a cable 68 comprising an inner stranded wire 70 (FIGS. 3 and 5) that runs in an outer housing 72. Housing 72 extends between a fixed bracket 74 on bowl 24 adjacent yoke 66, and fixed "seat" 76 inside a top wall 30*a* of recess 30 in moulding 22 (FIG. 5). The inner wire 70 is attached at one end to yoke 66 and at the opposite end to the foot pedal assembly 28 as will be described.

A similar cable 77 comprising an inner stranded wire 78 and an outer housing 80 also extends between assembly 28 and the water valve 52 (FIG. 4). Again, the outer cable extends between two fixed "seats" 82 in a wall of moulding 20 (FIGS. 11 and 12) and 84 in wall 30*a* of recess 30, and the inner wire 78 is actually coupled to the linkage 28 and to water valve 52. Again, details of the water valve are given in the '988 patent referred to previously.

The two cables or wires 70 or 78 provide elongate actuating elements that extend between the assembly 28 and the bowl seal and water supply valve respectively and that are tensioned to actuate those components of the toilet.

Figure 6:
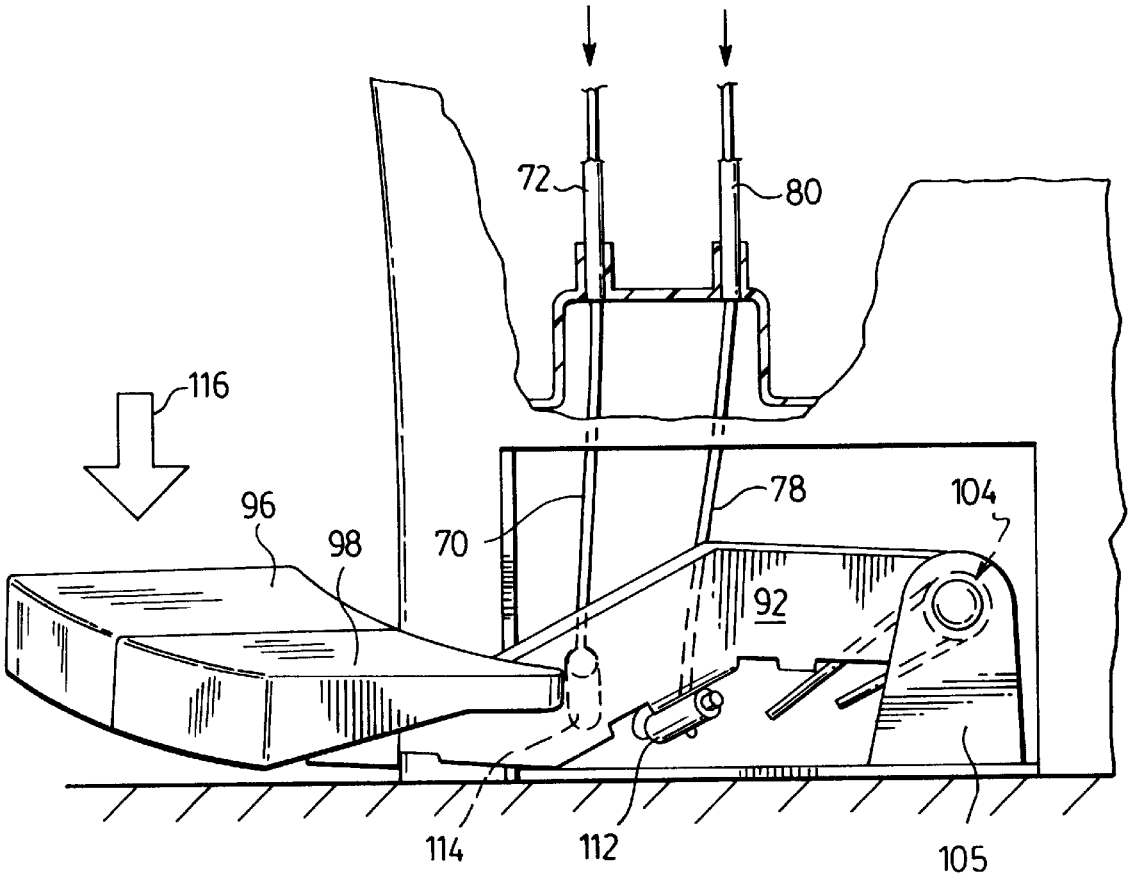
FIG. 6 is a view similar to FIG. 5 illustrating normal operation of the foot pedal assembly for flushing the toilet.
Figure 7:
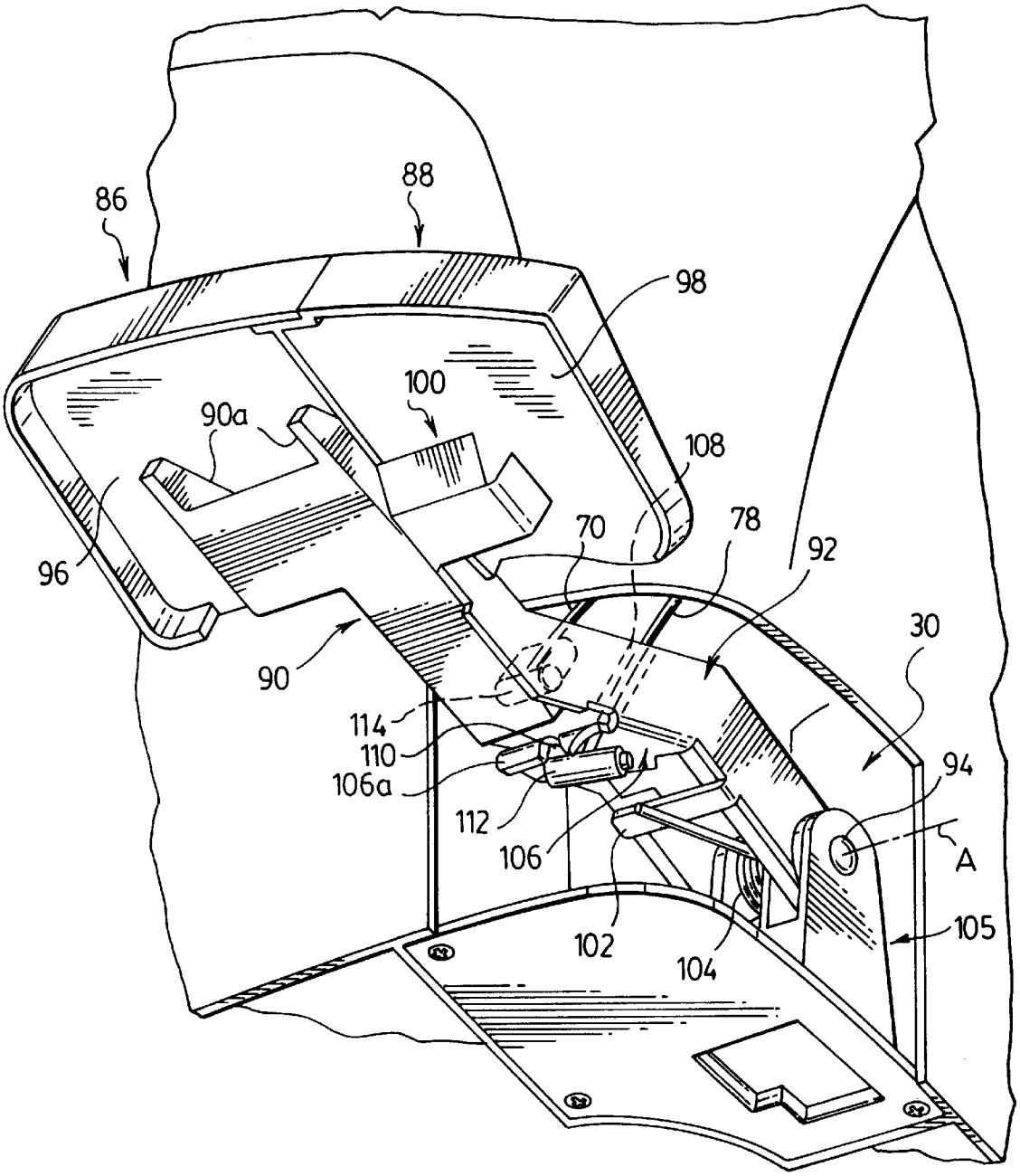
FIG. 7 is an underneath perspective view of the foot pedal assembly as shown in FIG. 5.

Reference will now be made primarily to FIGS. 5, 6 and 7 in describing the foot pedal assembly 28.

FIG. 7 of the drawings best illustrates the overall structure of the foot pedal assembly. The assembly includes first and second foot pedals denoted 86 and 88, for actuating respectively the bowl closure means (bowl seal 58) and the water supply means (including water valve 52) of the toilet. Each foot pedal includes an arm having an outer end portion accessible to a user of the toilet externally of the housing and an inner end portion coupled to the housing about a pivot axis oriented so that up and down movement of the outer end portion of the arm causes the arm to move about the pivot axis.

Figure 8:
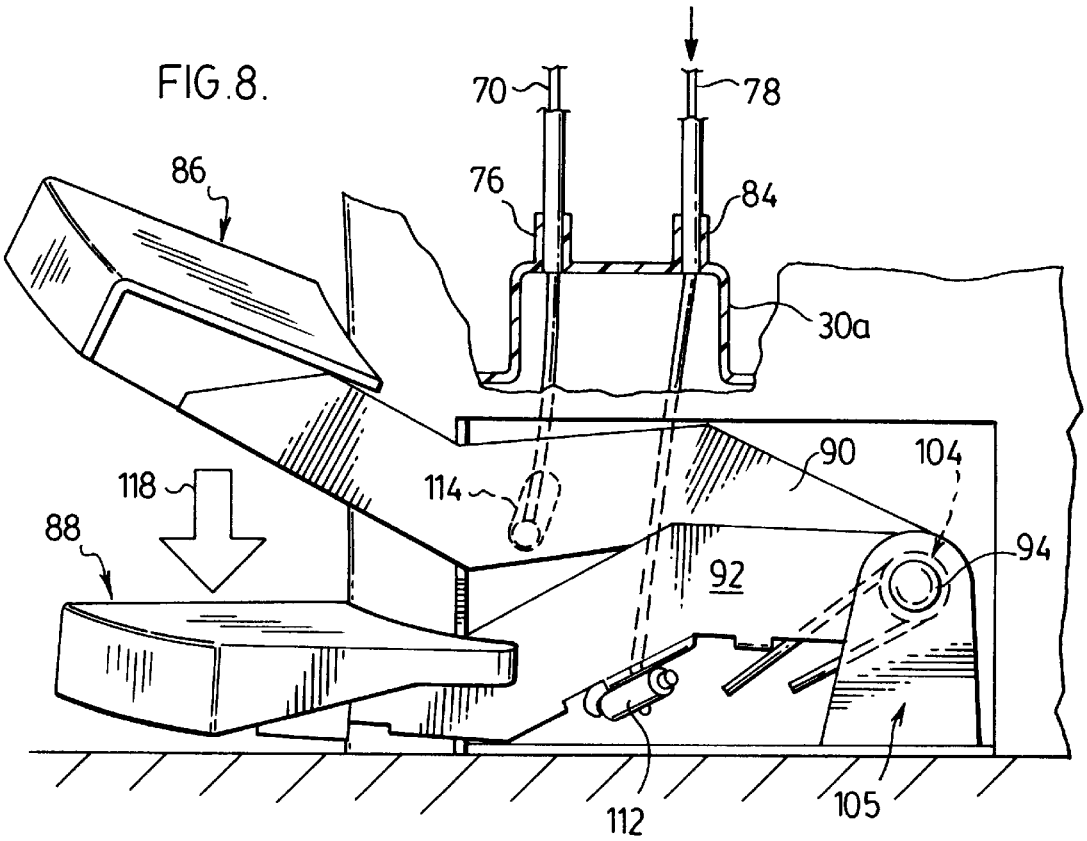
FIGS. 8 and 9 are views similar to FIG. 5 showing alternative ways of operating a foot pedal assembly.

In the illustrated embodiment, there is a common pivot axis A for both pivot arms. The arm of pedal 86 is denoted 90, while the arm for foot pedal 88 is denoted 92. Both arms are pivoted at their inner ends on a pivot pin 94 for turning about axis A. At their outer ends, the arms carry respective foot plates 96 and 98, both of which are plastic mouldings. Arm 90 (for operating the bowl closure means) may be considered as the "main" arm of the foot pedal assembly and is a relatively sturdy plastic moulding having a generally square profile in cross-section, flat sides and a somewhat angled shape as best seen in FIG. 8. Foot plate 96 is secured by a pair of plastic pins (not shown) to a generally fork-shaped formation 90*a* at the outer end of arm 90. Arm 92 on the other hand is formed in one piece from relatively thin gauge sheet steel. The two arms 90 and 92 are disposed side-by-side and the steel arm 92 in effect lies directly along one of the flat sides of the main plastic arm 90 in the rest position of the foot pedals (shown in FIG. 7). The arms can, however, move independently of one another.

A flange 100 extends laterally from arm 92 in a direction away from arm 90 at the outer end of arm 92 and carries the foot plate 98. Again, a plastic pin (not shown) is used to secure the foot pedal to the flange.

Closer to the pivot pin 94, an integral steel "finger" 102 extends laterally to the opposite side of arm 92 across the bottom surface of arm 90. This "finger" provides an abutment against which bears one limb of a torsion spring 104 on pin 94. FIG. 5, for example, shows that spring 104 has two limbs 104*a* and 104*b* which bear respectively against "finger" 102 of arm 92 and against a part of a plastic moulded bracket 105 that carries pivot pin 94. Thus, spring 104 in effect biasses both arms 90 and 92 upwardly at their outer ends to the rest position shown in FIG. 7. The rest position is defined by abutment of the arms with the top edge of the recess 30 in the toilet housing.

With continued reference to FIG. 7, it will be seen that arm 92 also has an integral lateral extension 106 that extends below arm 90 generally at the mid-point of its length. This lateral extension forms an attachment point for the inner wire 78 of the cable 80 that extends to the flush water valve 52 of the toilet. Cable 78 in fact extends through an opening 108 in the other arm 90 in passing to the attachment point represented by extension 106. The wire is received in a longitudinal slot 110 in extension 106 and the slot opens into the end of extension 106 that is closest to the outer ends of the arms. This portion of the extension is "rolled" slightly as indicated at 106*a* and the end of wire 78 is provided with a cylindrical fitment 112 that extends at right angles to the wire itself in a T-configuration.

The wire 70 of the cable 72 for operating the bowl closure means of the toilet also has a similar cylindrical fitment 114 at its outer end. This wire 70 extends directly to the main arm 90 of the a foot pedal assembly and is in effect "hooked" into a complimentarily-shaped recess that opens into the top surface of arm 90.

Figure 9:
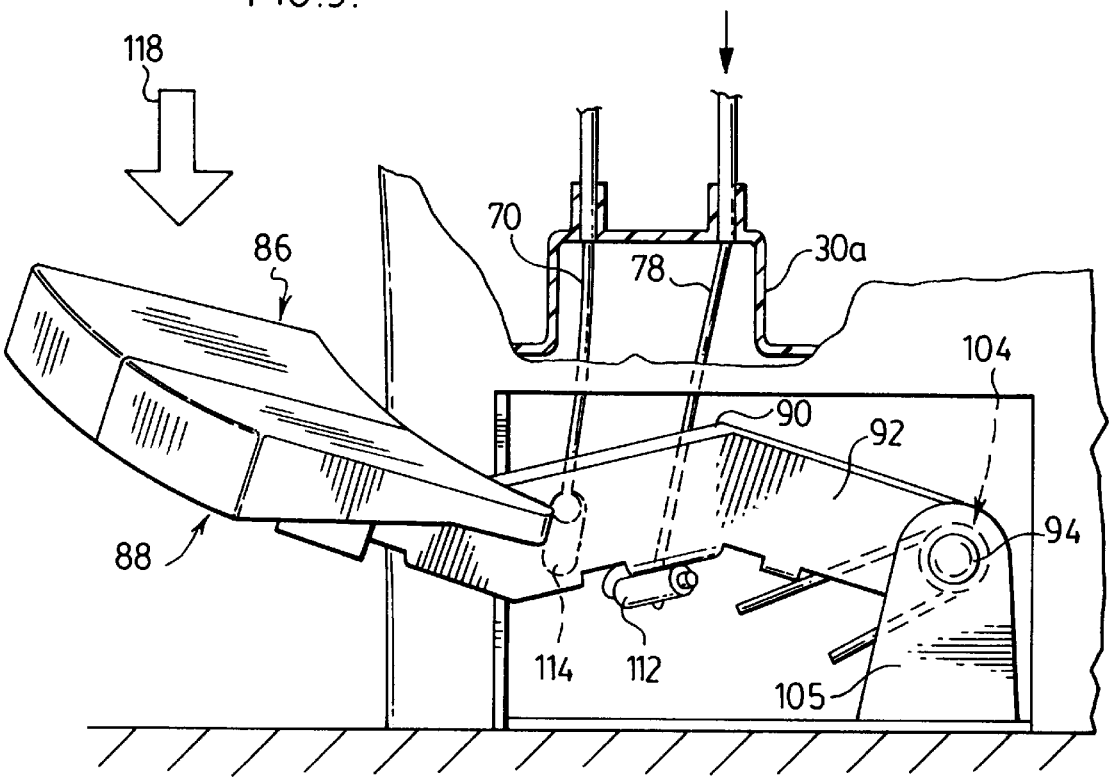

To flush the toilet in normal use, the user simply presses down on the left hand foot pedal 86 as indicated by the arrow 116 in FIGS. 6 and 9. This causes arm 90 to pivot downwardly at its outer end and carries with it arm 92 by virtue of the action of arm 90 on the lateral extension 106 from arm 92. Both wires 70 and 78 are thereby tensioned, opening the bowl outlet by moving bowl closure member 58 to the side, and opening the water flush valve 52 for delivering water into the bowl 24. When the foot pedal is released, spring 104 returns both foot pedals to their upper rest positions.

Alternatively, if it is wished simply to add water to the bowl 24, the user pushes downward on the second or right hand foot pedal 88 as indicated by the arrow 118 in FIG. 8. Arm 92 then moves down, opening the water valve 52 while arm 90 remains in its normal rest position and the bowl outlet is not opened. When the foot pedal is released, spring 104 returns it to the rest position.

In the event of failure of the water flush pedal 88, for example, if the foot plate 98 should be broken off or if arm 92 itself should break, the water valve can be opened by depression of arm 90 due to the fact that the actuating wire 78 of the water flush valve passes through arm 90. Since fitment 112 is larger than the opening 108 through arm 90, even if the fitment should become dislodged from extension 106, the wire will not become detached from arm 90. As indicated previously, this means that water can be added to the bowl of the toilet, so that the toilet can be left in a sanitary condition while awaiting service, even though arm 92 may be broken.

Figure 10:
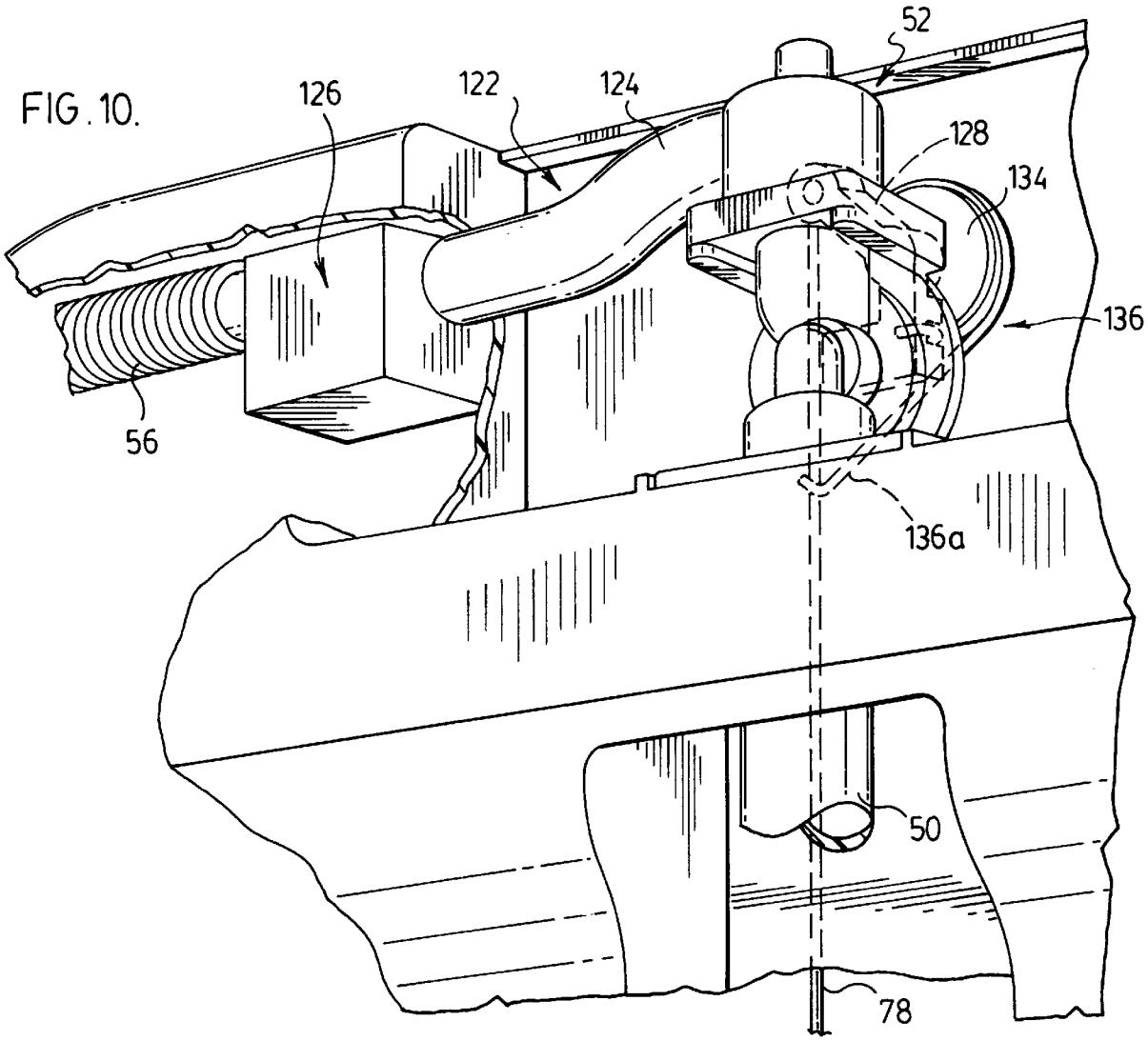
FIG. 10 is a perspective view of the water valve of the toilet.
Figure 11:
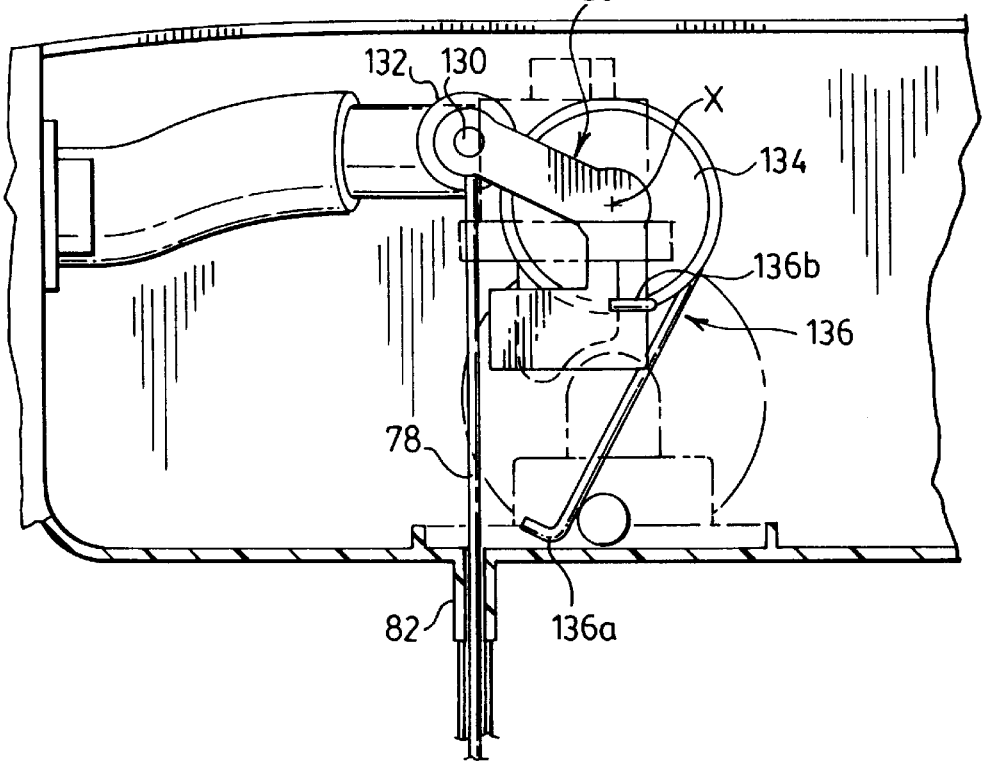
FIGS. 11 and 12 are elevational views from the opposite side of the water valve to that visible in FIG. 10, illustrating operation of the valve.
Figure 12:
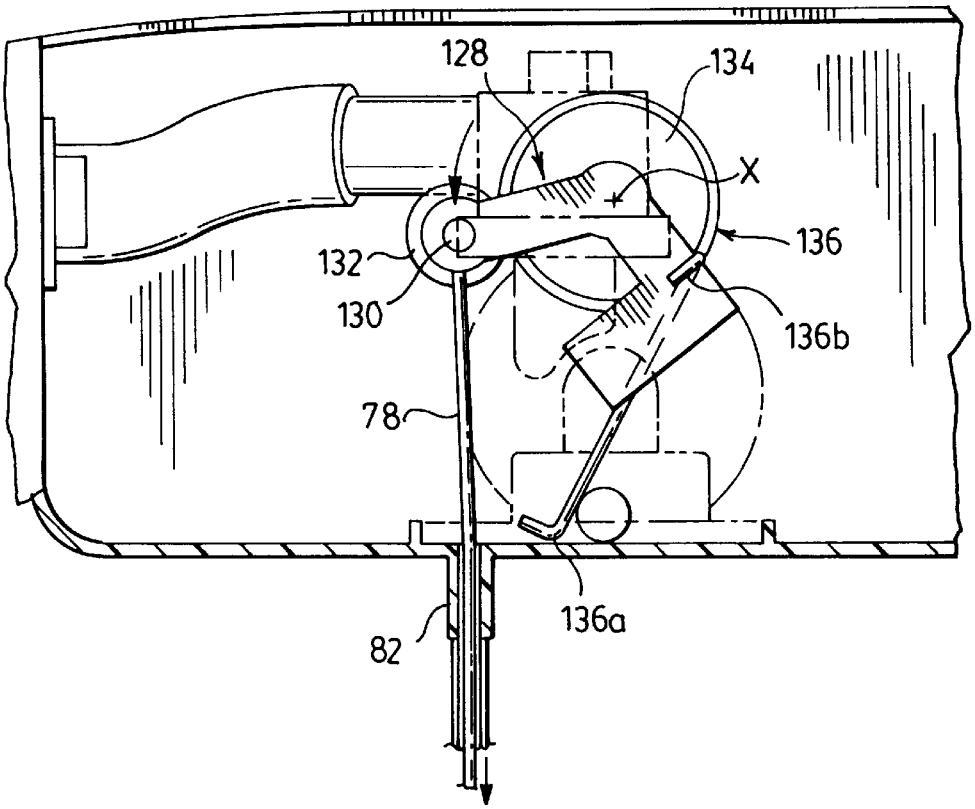

For the sake of completeness of illustration, FIGS. 10, 11 and 12 show in some detail the water valve 52 and adjacent structure. FIG. 10 is a view from the rear of the toilet generally in the direction of arrow B in FIG. 1. In that view, reference numeral 120 denotes a cover plate for a recess at the rear of the toilet in which the valve 52 is located. FIG. 10 shows that recess (at 122) after removal of cover 120. A water inlet pipe 50 extends to valve 52. An outlet hose from the valve is indicated at 124 and extends through a diffuser 126 leading to the hose 56 referred to previously (see FIG. 3).

Valve 52 itself is of known construction (see the '988 patent supra) and need not be described in detail. For present purposes, it is sufficient to note that the valve is opened and closed by turning a quadrant generally denoted 128 in FIGS. 11 and 12 about an axis X of the valve spindle. Quadrant 128 is at the rear side of the valve as seen in FIG. 10; in other words, FIGS. 11 and 12 are views from the opposite sides of the valve.

Inner wire 78 from the cable 80 that connects to foot pedal 88 extends generally vertically upwardly through the fitment 82, in which the outer housing of the cable is retained. Wire 78 has a T-fitment 130 at its outer end similar to the fitments 112 and 114 at the foot pedal ends of the two actuating wires. This fitment 130 is received in a complimentary slot in a "boss" 132 at the outer end of one arm of quadrant 128. Thus, downward movement of wire 78 from the position shown in FIG. 11 to that shown in FIG. 12 causes the quadrant 128 to rotate, opening the valve.

The valve spindle, in addition to quadrant 128, carries a cylindrical boss 134 around which extends a torsion spring 136. One limb (136*a*) of the coil spring bears against a fixed stop 138, while the other limb (136*b*) of the coil spring is hooked around the other limb of the quadrant 128 so as to bias the quadrant in the clockwise direction shown in FIGS. 11 and 12, i.e. towards the closed position of the valve.

It will of course be appreciated that the preceding description relates to a particular preferred embodiment of the invention only and that many modifications are possible within the broad scope of the invention. For example, while specific structure has been shown for the two pedals of the foot pedal assembly, foot pedals of different configurations can be used.

Elongate actuator elements other than cables comprising an inner wire within an outer housing could also be used—for example wire and pulley arrangements.

I claim:

1. A toilet comprising:

a housing which includes a bowl for receiving waste, the bowl having an outlet;

bowl closure means normally closing said outlet and operable to open the outlet for discharge of waste from the bowl;

water supply means operable to deliver water into the bowl;

a foot pedal assembly comprising first and second foot pedals for actuating respectively said bowl closure means and said water supply means, each foot pedal comprising an arm having an outer end portion accessible to a user of the toilet externally of the housing and an inner end portion coupled to the housing about a pivot axis oriented so that up or down movement of said outer end portion of the arm causes the arm to move about said pivot axis, said arms of the respective foot pedals being disposed side-by-side and the arm of said second foot pedal including a lateral extension below the arm of said first foot pedal so that depression of the first foot pedal also causes depression of the second foot pedal; and, first and second actuating elements extending between the foot pedals and the bowl closure means and the water supply means respectively, the bowl closure means being opened by tensioning of said first actuating element and the water supply means being operated by tensioning of said second actuating element, said first actuating element being coupled to the arm of said first foot pedal at a location between said end portions of the pedal so that depression of the pedal tensions the element, and said second actuating element extending through an opening in the arm of said first foot pedal and being coupled to said lateral extension of the arm of the second foot pedal, said second actuating element including, below said arm of the first foot pedal, an end fitment larger than said opening in the first foot pedal arm, whereby said second actuating element can be tensioned by depression of said first foot pedal arm in the event of failure of said second foot pedal arm or extension.

2. A toilet as claimed in claim 1, wherein opposing faces of the arms of the respective foot pedals are flat, and wherein the arm of the second foot pedal comprises a member which is planar in a direction normal to said pivot axis, for up and down movement closely adjacent the arm of said first foot pedal.

3. A toilet as claimed in claim 2, wherein said planar member is formed from sheet steel and includes an integral tab that is folded out of the general plane of the member to form said lateral extension of the arm below the first foot pedal.

4. A toilet as claimed in claim 3, wherein said integral lateral extension includes a longitudinal slot which is aligned with said opening in the arm of the first foot pedal, for receiving said second actuating element, and wherein said lateral extension has a downwardly rolled outer end portion forming a seat for receiving said end fitment on the second actuating element, said fitment having a generally cylindrical overall configuration.

5. A toilet as claimed in claim 1, wherein said actuating elements comprise respective cables each including an inner wire and an outer housing, said outer housings extending to respective seats in said toilet housing above said foot pedal assembly, the wires of the respective cables extending through said seats to said first and second foot pedals.

6. A toilet as claimed in claim 1, wherein said foot pedal assembly is received in a recess in a lower front area of the toilet so that foot pedals are accessible to a user standing in front of the toilet, and wherein the foot pedal assembly includes spring means biassing said arms to an upper rest position defined by abutment with an upper edge of said recess.

* * * * *